US005218575A

United States Patent [19]

Cherek

[11] Patent Number: 5,218,575

[45] Date of Patent: Jun. 8, 1993

[54] ACOUSTIC TRANSDUCER

[75] Inventor: Bogdan Cherek, Peterborough, Canada

[73] Assignee: Milltronics Ltd., Peterborough, Canada

[21] Appl. No.: 941,201

[22] Filed: Sep. 4, 1992

[51] Int. Cl.[5] ..... H04R 1/17

[52] U.S. Cl. ..... 367/140; 367/163; 367/174; 181/173; 310/334

[58] Field of Search ..... 367/160, 162, 176, 163, 367/174, 140; 181/173; 310/334, 326

[56] References Cited

U.S. PATENT DOCUMENTS

| | | | |
|---|---|---|---|
| 3,584,160 | 6/1971 | Janssen | 181/157 |
| 3,849,679 | 11/1974 | Massa | 310/324 |
| 4,056,742 | 11/1977 | Tibbetts | 310/357 |
| 4,333,028 | 6/1982 | Panton | 310/326 |
| 4,395,652 | 7/1983 | Nakanishi et al. | 310/334 |
| 4,768,615 | 9/1988 | Steinebrunner et al. | 181/157 |
| 5,015,929 | 5/1991 | Cathignol et al. | 310/335 |

OTHER PUBLICATIONS

Ultrasonics, Nov. 1978, pp. 267-271, "An Ultrasonic Transducer for High Power Applns. in Gases" Gallego-Juarez et al.

Journal of Sound & Vibration, (1973) 26(3), pp. 411-416, Gallego-Juarez.

The Journal of Acoustic Society of America, 1972, vol. 51, No. 3, Part 2, pp. 953-959, Barone et al.

*Primary Examiner*—J. Woodrow Eldred

*Attorney, Agent, or Firm*—Ridout & Maybee

[57] ABSTRACT

A flexural mode acoustic transducer system for use in pulse-echo ranging systems has a radiating plate of which even-numbered antinodal zones, counting from a drive connection to a driving element at the center of the plate, are formed with rings of apertures to reduce the radiating areas of those zones, thus reducing cancellation in the far field, and improving the matching of the device to the atmosphere into which the plate is radiating. The plate is backed by a sound deadening layer on a flange of a transducer housing, from which it is separated by a foil which is non-adherent to the plate, and is preferably covered by an acoustically transparent fabric having a pore size small enough to exclude damaging particulates.

10 Claims, 2 Drawing Sheets

ACOUSTIC TRANSDUCER

BACKGROUND OF THE INVENTION

1. Field of the Invention

This invention relates to acoustic transducers for use in pulse-echo acoustic ranging systems, and more particularly to transducers of the flexural mode type.

2. Review of the Art

Commonly assigned U.S. Pat. No. 4,333,028 (Panton), issued Jun. 1, 1982, describes a flexural mode transducer suitable for use in pulse-echo acoustic ranging systems, and also discusses prior art flexural mode transducers such as those described in an article in Ultrasonics, November 1978, "An Ultrasonic Transducer for High Power Applications in Gases", which had characteristics such as extremely high Q which rendered them unsuitable for use in echo-ranging applications. The Panton transducer has been very successful in a wide range of applications, but problems have arisen in certain applications due to difficulties in finding materials to form the matching rings applied to the transducer plate which exhibit consistent acoustic properties and provide good performance over extended intervals in applications involving extreme temperatures (high or low) and/or aggressive atmospheres.

In order to meet these problems it has been proposed in U.S. Pat. No. 4,768,615 (Steinebrunner et al) to replace the matching rings used by Panton by a rigid, apertured masking plate in front of the flexural oscillator plate, defining annular rings which mask the radiation from adjacent antinodal zones of the oscillator plates , whilst air between the rings formed low-loss coupling means matching the remaining zone of the plate to the atmosphere. Whilst such a masking plate can readily be made resistant to extreme temperatures and aggressive atmospheres, the arrangement is inherently less efficient than those preferred embodiments of the Panton arrangement which seek to match the phases of radiation from adjacent antinodal zones, since the radiation from alternate antinodal zones is necessarily lost, and the coupling of the remaining zones by the air between the rings renders it less easy to obtain a system Q which is low enough to provide a rapid ring-down of the transducer following transmission of a ranging pulse. Furthermore, it is difficult to provide adequately against particulate material becoming trapped between the masking plate and the oscillating plate, with deleterious effects upon the performance of the transducer.

SUMMARY OF THE INVENTION

It is an object of the present invention to provide a flexural mode transducer, for use in pulse-echo ranging applications, which addresses practical difficulties which experience has shown may be encountered with both the Panton and Steinebrunner et al transducers, and which furthermore offers the possibility of easier fabrication than either of the prior art designs whilst combining their advantages.

According to the invention, there is provided in a broadly tuned directional transducer system comprising a generally planar radiating plate having a higher flexural mode resonance at substantially the operating frequency of the system, and a transducer element of much smaller effective area than the plate and coupled to an antinodal zone thereof, the improvement wherein alternate antinodal zones of a radiating surface of the plate define rings of apertures occupying a substantial portion of the area of each such zone whereby substantially to reduce the radiating area of such zones.

In a preferred arrangement, a housing is provided for the transducer element, the transducer element is coupled to the center of the plate, which is circular, and the housing is provided with a flange covered with sound deadening material and backing that surface of the plate opposite the radiating surface, the rear surface of the plate intermediate a periphery and center thereof being free of any mechanical coupling to the sound deadening material. Such freedom is preferably ensured by interposition, between the plate and the sound deadening material, of a foil which is non-adherent to the plate.

SHORT DESCRIPTION OF THE DRAWINGS

Figure 1:
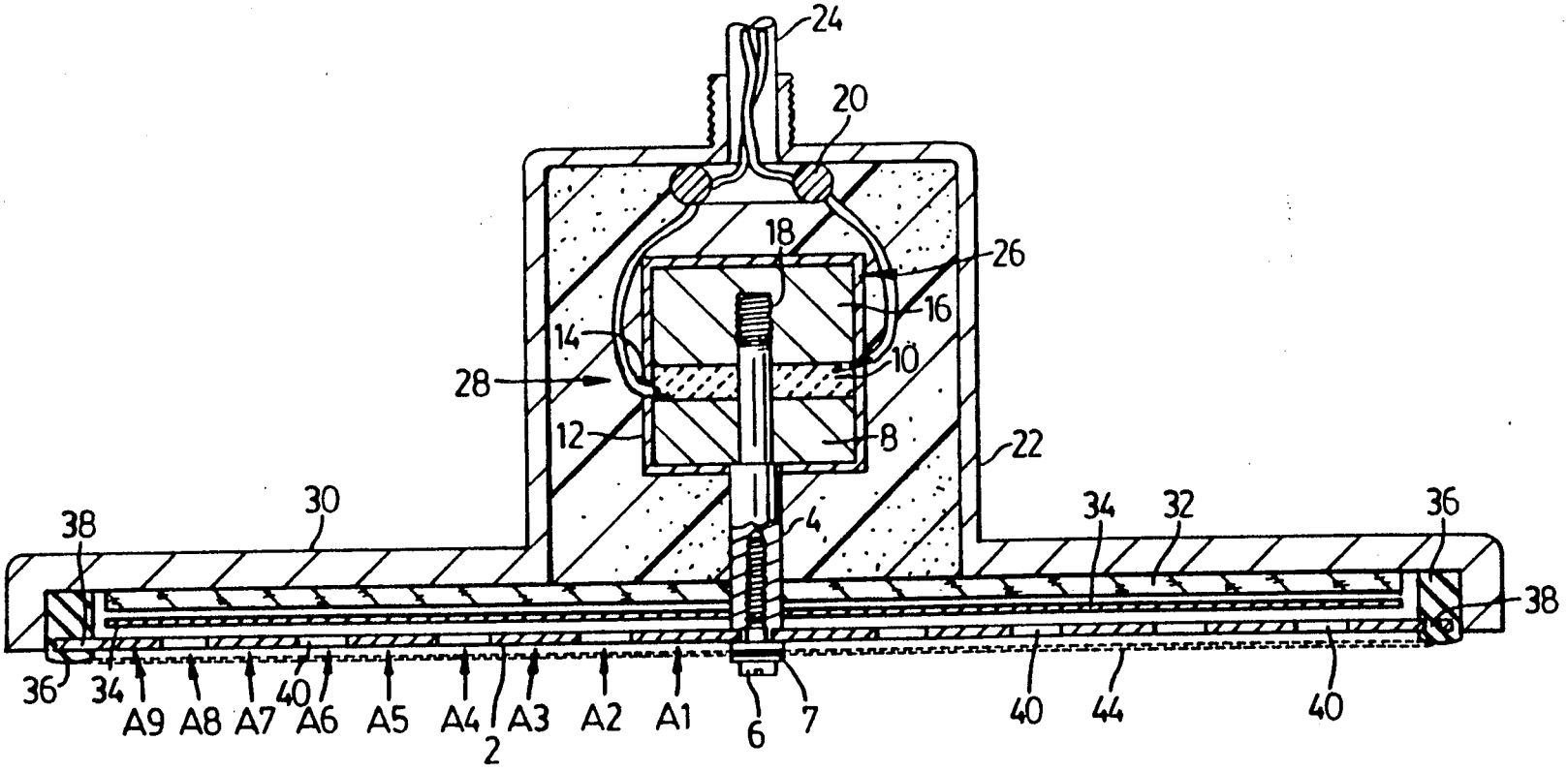
FIG. 1 is a diametrical section through a transducer in accordance with the invention.
Figure 2:
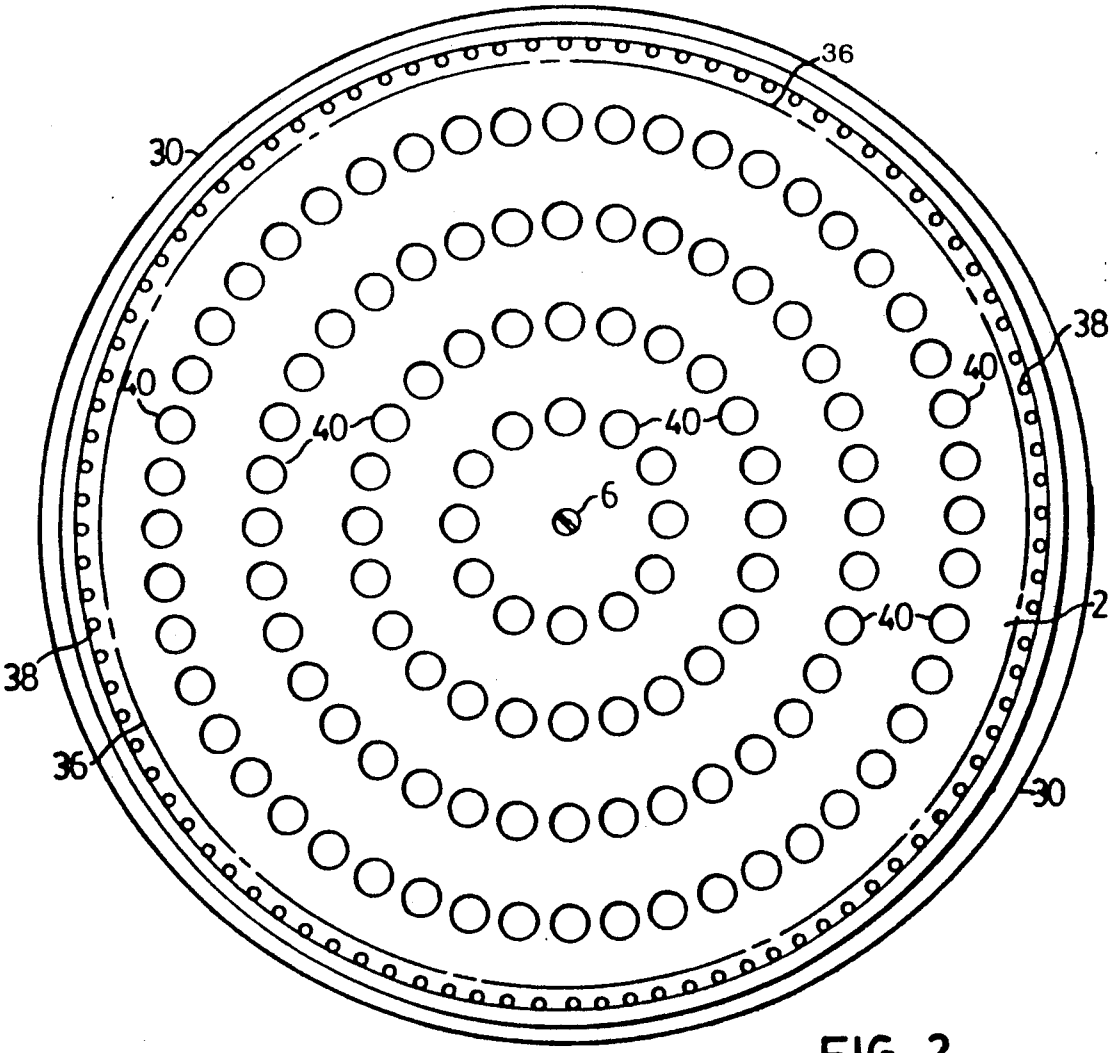
FIG. 2 is a plan view of a radiating surface of the radiating plate of the transducer of FIG. 1.

Referring to FIGS. 1 and 2, overall construction of the transducer is broadly similar to that of the transducers shown in the Panton and Steinebrunner et al patents considered above, except for the absence of any beam shaping components in front of a circular planar radiating plate 2. The circular plate 2 is secured at a centre of its rear surface to one end of an axial driver post 4 by a screw 6 and washer 7, the other end of the driver post 6 being connected to a first loading block 8 of a transducer assembly comprising an annular element 10 of piezo-electric ceramic such as lead zirconate titanate sandwiched between conductive shims 12, 14 and the first and a second more massive loading block 16, secured together and to the post 6 by an axial bolt 18. Pulses of alternating potential utilized to energize the transducer are applied to the element 10 through the shims 12 and 14 from the secondary of a toroidal transformer 20 within a transducer housing 22, a primary winding of the transformer being externally connected to pulse-echo varying equipment by a shielded cable 24 passing through an aperture in an end of the housing. The frequency of the alternating potential is at or close to a flexural mode resonant frequency of the plate 3 so as to excite a higher order flexural mode vibration setting up a series of alternating annular nodal and antinodal zones in the vibrating plate.

The transducer assembly is wrapped in a layer of cork 26 and it and the transformer 20 are sealed within the housing 22 by filling the latter with a slightly elastic potting compound 28 selected to withstand operating temperatures to which the transducer may be subjected. The housing 22 has a circular flange 30 extending behind the rear surface of the plate 2. The flange 30 is covered with a sound deadening layer of material 32, such as cork or some alternative material selected to withstand higher working temperatures, which layer is covered by a thin metal or synthetic plastic sound reflective sheet or foil 34 which serves to prevent losses to mechanical coupling 10 or excessive absorbtion by the material 32. In the example shown, the outer periphery of the plate 2 is bonded to the flange 30 by a bead 36 of bonding material, for example an elastomeric silicone resin, bonding to the plate 2 being improved by a ring of small holes 38 in the plate. The bead should be located in a nodal zone (as shown).

The antinodal zones of the plate 2 in FIGS. 1 and 2 are numbered A1, A2, A3, A4, A5, A6, A7, A8 and A9, it being understood that the number of such zones is exemplary only. The even numbered zones A2, A4, A6 and A8 have rings of apertures 40, the number and size of the apertures being sufficient to reduce substantially the radiating surface area of these zones without substantially prejudicing the mechanical integrity of the plate. This area reduction of the even numbered zones substantially reduces radiation from these zones and thus also reduces the cancellation of radiation from the odd numbered zones which vibrate in antiphase to the even numbered zones, whilst the apertures provide a selective damping effect on the even numbered zones which further reduces radiation from these zones and helps control the Q of the assembly and improve the matching to air.

Since the amplitude of vibration of the plate drops off rapidly from the centre towards the edges, it is preferred that the apertures be formed in the even numbered zones so that the high amplitude of radiation from zone A1 can be exploited rather than needing to be cancelled. The rate of amplitude drop off can be controlled by varying the thickness of the plate in the radial direction, but the additional complications in design and manufacture will usually outweigh the advantages of adopting such a feature.

The size, shape and spacing and location of the rings of holes may be varied so as to adjust the transducer frequency response. The holes have comparatively little effect on the centre frequency of the transducer. In the example shown in FIGS. 1 and 2, round holes 40 of a diameter of about three-quarters of the width of an antinodal zone (i.e. the spacing between nodes), spaced in rings at a pitch of about 1.4 diameters, are utilized. Although this reduces the area of an antinodal zone by about 50% the reduction in radiation is substantially greater, both because the reduction is concentrated in the centre of the zone where radiation would be greatest, and because of the damping effect of the holes. The hole shapes and spacing may be varied, even from zone to zone within a particular unit, with a view to adjusting the polar pattern and bandwidth characteristics of the transducer, optimizing Q (which should be kept low enough to prevent excessive ringing) and improving bandwidth, and optimizing efficiency which entails transferring as much as possible of the electrical energy applied to the transducer into the sonic beam produced by the transducer. It should be appreciated that the holes 40 do not only influence the radiating properties of the plate and improve its matching to the atmosphere. They will not substantially affect the positions of the flexural mode nodes and antinodes in the plate. The characteristics of different rings of holes 40 may be adjusted in order to shape the bandpass characteristics of the transducer in a manner somewhat analogous to other forms of multi-pole filters. The size, shape and number of holes in different zones may also be adjusted to control the proportions of radiated energy from different zones, in order to adjust the polar radiation pattern of the transducer, which is largely determined by interference between radiation from the various zones. The complexities of the interactions of the various parameters are such that optimal configurations must be determined empirically, guided by the theoretical acoustic principles involved and the desired properties of the transducer. The arrangement shown in FIG. 2 represents a presently preferred arrangement for general purpose usage. In general, the spacing between the holes should be less than about 1.6 diameters, and sufficiently greater than the theoretical minimum of one diameter to maintain sufficient strength and rigidity in the plate, and their diameter should be about 50% to 100% of the distance between adjacent nodes.

It is of importance for consistency of performance that particulate matter does not become lodged between the plate 2 and the foil 34 since this may produce a mechanical interaction which will alter the transducer characteristics. It is thus preferred that transducers which are to be used in environments in which damaging particulate matter may be present be provided with a substantially acoustically transparent cover layer 44 in front of the plate which is effective to exclude particles large enough to represent a hazard to transducer performance. A suitable material for the cover layer 44 is a polytetrafluoroethylene fabric having micron pore sizes, such as that sold under the trademark GORE-TEX.

Variations are possible in the arrangements described above. For example, forward projections from the flange 30 or the layer 32 could extend into the holes 40, and even be used to support a structure such as masking rings in front of the plate 2 comparable to those disclosed in the Steinebrunner et al patent. Although this might permit more complete suppression of radiation from the even-numbered antinodal zones whilst retaining many of the advantages of the present invention, the structure of the transducer would be considerably complicated.

The holes 40 may be of a wide range of shapes other than circular, for example square, segmental, hexagon or diamond-shaped, or may be formed in groups of two, four or other numbers of smaller holes of various shapes. We have however noted no configuration having significant advantages over circular holes, which are easy to form, and square holes appear to provide a slightly inferior performance.

I claim:

1. In a broadly tuned directional transducer system, comprising a generally planar radiating plate having a higher flexural mode resonance at substantially the operating frequency of the system, and a transducer element of much smaller effective area than the plate and coupled to an antinodal zone thereof, the improvement wherein alternate antinodal zones of a radiating surface of the plate define rings of apertures occupying a substantial portion of the area of each such zone whereby substantially to reduce the radiating area of such zones.

2. A transducer system according to claim 1, wherein a housing is provided for the transducer element, the transducer element is coupled to a centre of the plate, the plate is circular, and the housing is provided with a flange backing a rear surface of the plate opposite the radiating surface, the rear surface of the plate intermediate a periphery and the centre thereof being free of any mechanical coupling to the flange.

3. A transducer system according to claim 1, wherein the flange is covered with a sound deadening material, and a foil of material adherent to the plate is interposed between the sound deadening material and the plate.

4. A transducer system according to claim 3, wherein the periphery of the plate is flexibly bonded to the flange.

5. A transducer system according to claim 2, wherein the radiating surface of the plate is covered by a web of substantially acoustically transparent material which is substantially impervious to particulate material.

6. A transducer system according to claim 5, wherein the web is of fabric woven with micron pores.

7. A transducer system according to claim 1, wherein the apertures are circular holes.

8. A transducer according to claim 7, wherein the holes have a diameter which is approximately three-quarters of the width of the antinodal zone in which they are formed.

9. A transducer according to claim 8, wherein the holes are spaced to have a pitch of approximately 1.4 times their diameter.

10. A transducer according to claim 2 wherein, designating antinodal zones with numbers commencing at in the centre, the apertures are formed in even numbered zones.

* * * * *